US007310953B2

(12) United States Patent
Pham et al.

(10) Patent No.: US 7,310,953 B2
(45) Date of Patent: Dec. 25, 2007

(54) REFRIGERATION SYSTEM INCLUDING THERMOELECTRIC MODULE

(75) Inventors: Hung M. Pham, Dayton, OH (US); Wayne R. Warner, Piqua, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 11/272,109

(22) Filed: Nov. 9, 2005

(65) Prior Publication Data

US 2007/0101748 A1 May 10, 2007

(51) Int. Cl.
*F25B 21/02* (2006.01)

(52) U.S. Cl. ..... 62/3.2; 62/333

(58) Field of Classification Search ..... 62/3.1–3.7, 62/267, 335, 430–439
See application file for complete search history.

(56) References Cited

U.S. PATENT DOCUMENTS

| | | | | |
|---|---|---|---|---|
| 2,997,514 | A | 8/1961 | Roeder, Jr. | |
| 3,073,126 | A * | 1/1963 | Staebler | 62/3.3 |
| 3,111,813 | A | 11/1963 | Blumentritt | |
| 3,205,667 | A | 9/1965 | Frantti | |
| 3,212,274 | A | 10/1965 | Eidus | |
| 3,237,415 | A * | 3/1966 | Newton | 62/3.6 |
| 3,295,667 | A | 1/1967 | Kittle | |
| 3,481,393 | A | 12/1969 | Chu | |
| 3,559,437 | A | 2/1971 | Withers, Jr. | |
| 4,001,588 | A | 1/1977 | Elsner | |
| 4,109,707 | A | 8/1978 | Wilson et al. | |
| RE30,652 | E | 6/1981 | Germano et al. | |
| 4,281,516 | A | 8/1981 | Berthet et al. | |
| 4,362,023 | A | 12/1982 | Falco | |
| 4,383,414 | A | 5/1983 | Beitner | |
| 4,400,948 | A | 8/1983 | Moorehead | |
| 4,402,185 | A | 9/1983 | Perchak | |
| 4,499,329 | A | 2/1985 | Benicourt et al. | |
| 4,545,967 | A | 10/1985 | Reynolds et al. | |
| 4,611,089 | A | 9/1986 | Elsner et al. | |
| 4,622,822 | A | 11/1986 | Beitner | |
| 4,639,542 | A | 1/1987 | Bass et al. | |
| 4,644,753 | A | 2/1987 | Burke | |
| 4,730,459 | A | 3/1988 | Schlicklin et al. | |
| 4,734,139 | A | 3/1988 | Shakun et al. | |
| 4,744,220 | A | 5/1988 | Kerner et al. | |
| 4,764,193 | A | 8/1988 | Clawson | |
| 4,829,771 | A | 5/1989 | Koslow et al. | |
| 4,833,888 | A | 5/1989 | Kerner et al. | |
| 4,855,810 | A | 8/1989 | Gelb et al. | |
| 4,947,648 | A | 8/1990 | Harwell et al. | |
| 5,006,505 | A | 4/1991 | Skertic | |

(Continued)

FOREIGN PATENT DOCUMENTS

| | | |
|---|---|---|
| EP | 0 949 461 A2 | 10/1999 |

(Continued)

*Primary Examiner*—William E. Tapolcai
(74) *Attorney, Agent, or Firm*—Harness, Dickey & Pierce, P.L.C.

(57) ABSTRACT

A refrigeration system for multi-temperature and single-temperature applications combines a refrigeration circuit and a single-phase fluid heat-transfer circuit in heat-conducting contact through a thermoelectric device. A vapor compression cycle provides a first stage of cooling and the thermoelectric device in conjunction with the heat-transfer circuit provides the second stage of cooling. Polarity of the thermoelectric device can be reversed to provide a defrost function for the refrigeration system.

40 Claims, 5 Drawing Sheets

U.S. PATENT DOCUMENTS

| | | | |
|---|---|---|---|
| 5,022,928 | A | 6/1991 | Buist |
| 5,029,446 | A | 7/1991 | Suzuki |
| 5,057,490 | A | 10/1991 | Skertic |
| 5,092,129 | A | 3/1992 | Bayes et al. |
| 5,103,286 | A | 4/1992 | Ohta et al. |
| 5,154,661 | A | 10/1992 | Higgins |
| 5,156,004 | A | 10/1992 | Wu et al. |
| 5,168,339 | A | 12/1992 | Yokotani et al. |
| 5,222,216 | A | 6/1993 | Parish et al. |
| 5,232,516 | A | 8/1993 | Hed |
| 5,247,798 | A | 9/1993 | Collard, Jr. |
| 5,248,639 | A | 9/1993 | Elsner et al. |
| 5,292,376 | A | 3/1994 | Suse et al. |
| 5,304,846 | A | 4/1994 | Azar et al. |
| 5,314,586 | A | 5/1994 | Chen |
| 5,319,937 | A | 6/1994 | Fritsch et al. |
| 5,367,879 | A | 11/1994 | Doke et al. |
| 5,398,510 | A | 3/1995 | Gilley et al. |
| 5,409,547 | A | 4/1995 | Watanabe et al. |
| 5,431,021 | A | 7/1995 | Gwilliam et al. |
| 5,434,744 | A | 7/1995 | Fritz et al. |
| 5,436,467 | A | 7/1995 | Elsner et al. |
| 5,441,576 | A | 8/1995 | Bierschenk et al. |
| 5,448,109 | A | 9/1995 | Cauchy |
| 5,448,449 | A | 9/1995 | Bright et al. |
| 5,449,288 | A | 9/1995 | Bass |
| 5,456,081 | A | 10/1995 | Chrysler et al. |
| 5,456,164 | A | 10/1995 | Bang |
| 5,465,581 | A | 11/1995 | Haertl et al. |
| 5,470,395 | A | 11/1995 | Yater et al. |
| 5,471,850 | A | 12/1995 | Cowans |
| 5,501,076 | A | 3/1996 | Sharp, III et al. |
| 5,505,046 | A | 4/1996 | Nelson et al. |
| 5,515,238 | A | 5/1996 | Fritz et al. |
| 5,524,440 | A | 6/1996 | Nishioka et al. |
| 5,544,487 | A | 8/1996 | Attey et al. |
| 5,550,387 | A | 8/1996 | Elsner et al. |
| 5,584,183 | A | 12/1996 | Wright et al. |
| 5,588,300 | A | 12/1996 | Larsson et al. |
| RE35,441 | E | 2/1997 | Yokotani et al. |
| 5,605,047 | A | 2/1997 | Park et al. |
| 5,623,119 | A | 4/1997 | Yater et al. |
| 5,623,292 | A | 4/1997 | Shrivastava et al. |
| 5,636,520 | A | 6/1997 | Spauschus et al. |
| 5,644,185 | A | 7/1997 | Miller |
| 5,653,111 | A | 8/1997 | Attey et al. |
| 5,705,434 | A | 1/1998 | Imanishi et al. |
| 5,705,770 | A | 1/1998 | Ogasawara et al. |
| 5,713,208 | A | 2/1998 | Chen et al. |
| 5,715,684 | A | 2/1998 | Watanabe et al. |
| 5,722,158 | A | 3/1998 | Fritz et al. |
| 5,722,249 | A | 3/1998 | Miller, Jr. |
| 5,724,818 | A | 3/1998 | Iwata et al. |
| 5,737,923 | A | 4/1998 | Gilley et al. |
| 5,753,574 | A | 5/1998 | Donaldson et al. |
| 5,765,316 | A | 6/1998 | Kavarsky |
| 5,782,094 | A | 7/1998 | Freeman |
| 5,784,890 | A | 7/1998 | Polkinghorne |
| 5,802,856 | A | 9/1998 | Schaper et al. |
| 5,809,785 | A | 9/1998 | Polkinghorne |
| 5,813,233 | A | 9/1998 | Okuda et al. |
| 5,817,188 | A | 10/1998 | Yahatz et al. |
| 5,822,993 | A | 10/1998 | Attey |
| 5,823,005 | A | 10/1998 | Alexander et al. |
| 5,841,064 | A | 11/1998 | Maekawa et al. |
| 5,845,497 | A | 12/1998 | Watanabe et al. |
| 5,856,210 | A | 1/1999 | Leavitt et al. |
| 5,886,291 | A | 3/1999 | Imanishi et al. |
| 5,887,441 | A | 3/1999 | Spauschus et al. |
| 5,892,656 | A | 4/1999 | Bass |
| 5,921,087 | A | 7/1999 | Bhatia et al. |
| 5,924,289 | A | 7/1999 | Bishop, II |
| 5,927,078 | A | 7/1999 | Watanabe et al. |
| 5,950,067 | A | 9/1999 | Maegawa et al. |
| 5,969,290 | A | 10/1999 | Kagawa et al. |
| 5,981,863 | A | 11/1999 | Yamashita et al. |
| 5,987,891 | A | 11/1999 | Kim et al. |
| 5,994,637 | A | 11/1999 | Imanishi et al. |
| 6,003,319 | A | 12/1999 | Gilley et al. |
| 6,005,182 | A | 12/1999 | Imanishi et al. |
| 6,019,098 | A | 2/2000 | Bass et al. |
| 6,020,671 | A | 2/2000 | Pento et al. |
| 6,031,751 | A | 2/2000 | Janko |
| 6,034,317 | A | 3/2000 | Watanabe et al. |
| 6,043,423 | A | 3/2000 | Satomura et al. |
| 6,053,163 | A | 4/2000 | Bass |
| 6,067,802 | A | 5/2000 | Alonso |
| 6,076,357 | A | 6/2000 | Holdren et al. |
| 6,094,919 | A | 8/2000 | Bhatia |
| 6,096,964 | A | 8/2000 | Ghamaty et al. |
| 6,096,965 | A | 8/2000 | Ghamaty et al. |
| 6,096,966 | A | 8/2000 | Nishimoto et al. |
| 6,097,088 | A | 8/2000 | Sakuragi |
| 6,103,967 | A | 8/2000 | Cauchy et al. |
| 6,127,619 | A | 10/2000 | Xi et al. |
| 6,161,388 | A | 12/2000 | Uttam |
| 6,164,076 | A | 12/2000 | Chu et al. |
| 6,207,887 | B1 | 3/2001 | Bass et al. |
| 6,222,113 | B1 | 4/2001 | Ghoshal |
| 6,226,178 | B1 | 5/2001 | Broder et al. |
| 6,233,944 | B1 | 5/2001 | Yamada et al. |
| 6,252,154 | B1 | 6/2001 | Kamada et al. |
| 6,253,556 | B1 | 7/2001 | Schendel |
| 6,258,215 | B1 | 7/2001 | Samsonov et al. |
| 6,264,446 | B1 | 7/2001 | Rajendran et al. |
| 6,266,962 | B1 | 7/2001 | Ghoshal |
| 6,272,873 | B1 | 8/2001 | Bass |
| 6,274,802 | B1 | 8/2001 | Fukuda et al. |
| 6,274,803 | B1 | 8/2001 | Yoshioka et al. |
| 6,279,337 | B1 | 8/2001 | Davidson et al. |
| 6,279,470 | B2 | 8/2001 | Simeray et al. |
| 6,282,907 | B1 | 9/2001 | Ghoshal |
| 6,293,107 | B1 | 9/2001 | Kitagawa et al. |
| 6,295,819 | B1 | 10/2001 | Mathiprakasam et al. |
| 6,307,142 | B1 | 10/2001 | Allen et al. |
| 6,308,519 | B1 | 10/2001 | Bielinski |
| 6,313,636 | B1 | 11/2001 | Pohl et al. |
| 6,319,437 | B1 | 11/2001 | Elsner et al. |
| 6,324,860 | B1 | 12/2001 | Maeda et al. |
| 6,338,251 | B1 * | 1/2002 | Ghoshal ..... 62/3.2 |
| 6,345,506 | B1 | 2/2002 | Kontani et al. |
| 6,345,507 | B1 | 2/2002 | Gillen |
| 6,351,950 | B1 | 3/2002 | Duncan |
| 6,354,002 | B1 | 3/2002 | Wright et al. |
| 6,359,440 | B2 | 3/2002 | Pohl et al. |
| 6,362,959 | B2 | 3/2002 | Tracy |
| 6,370,882 | B1 | 4/2002 | Adamski et al. |
| 6,370,884 | B1 | 4/2002 | Kelada |
| 6,393,842 | B2 | 5/2002 | Kim et al. |
| 6,400,013 | B1 | 6/2002 | Tsuzaki et al. |
| 6,401,461 | B1 | 6/2002 | Harrison et al. |
| 6,401,462 | B1 | 6/2002 | Bielinski |
| 6,410,971 | B1 | 6/2002 | Otey |
| 6,412,287 | B1 | 7/2002 | Hughes et al. |
| 6,418,729 | B1 | 7/2002 | Dominguez-Alonso et al. |
| 6,438,964 | B1 | 8/2002 | Giblin |
| 6,439,867 | B1 | 8/2002 | Clendenin |
| 6,444,893 | B1 | 9/2002 | Onoue et al. |
| 6,446,442 | B1 | 9/2002 | Batchelor et al. |
| 6,463,743 | B1 | 10/2002 | Laliberte |
| 6,466,002 | B1 | 10/2002 | Elsner et al. |
| 6,489,551 | B2 | 12/2002 | Chu et al. |
| 6,490,869 | B1 | 12/2002 | Uetsuji et al. |
| 6,490,874 | B2 | 12/2002 | Chu et al. |

| | | | |
|---|---|---|---|
| 6,519,947 | B1 | 2/2003 | Bass et al. |
| 6,521,991 | B1 | 2/2003 | Yamada et al. |
| 6,527,548 | B1 | 3/2003 | Kushch et al. |
| 6,530,231 | B1 | 3/2003 | Nagy et al. |
| 6,532,749 | B2 | 3/2003 | Rudick et al. |
| 6,548,750 | B1 | 4/2003 | Picone |
| 6,548,894 | B2 | 4/2003 | Chu et al. |
| 6,560,968 | B2 | 5/2003 | Ko |
| RE38,128 | E | 6/2003 | Gallup et al. |
| 6,574,967 | B1 | 6/2003 | Park et al. |
| 6,580,025 | B2 | 6/2003 | Guy |
| 6,588,215 | B1 | 7/2003 | Ghoshal |
| 6,595,004 | B1 | 7/2003 | Ghoshal |
| 6,598,403 | B1 | 7/2003 | Ghoshal |
| 6,612,116 | B2 | 9/2003 | Fu et al. |
| 6,619,044 | B2 | 9/2003 | Batchelor et al. |
| 6,620,994 | B2 | 9/2003 | Rossi |
| 6,624,349 | B1 | 9/2003 | Bass |
| 6,655,172 | B2 | 12/2003 | Perevozchikov et al. |
| 6,662,570 | B2 | 12/2003 | Venkatasubramanian |
| 6,662,571 | B1 | 12/2003 | Nagy et al. |
| 6,679,683 | B2 | 1/2004 | Seibel et al. |
| 6,700,053 | B2 | 3/2004 | Hara et al. |
| 6,705,089 | B2 | 3/2004 | Chu et al. |
| 6,715,298 | B2 | 4/2004 | Guo et al. |
| 6,722,139 | B2 | 4/2004 | Moon et al. |
| 6,727,423 | B2 | 4/2004 | Tauchi et al. |
| 6,735,959 | B1 | 5/2004 | Najewicz |
| 6,739,138 | B2 | 5/2004 | Saunders et al. |
| 6,759,586 | B2 | 7/2004 | Shutoh et al. |
| 6,767,766 | B2 | 7/2004 | Chu et al. |
| 6,770,808 | B2 | 8/2004 | Itakura et al. |
| 6,807,811 | B2 | 10/2004 | Lee |
| 6,815,814 | B2 | 11/2004 | Chu et al. |
| 6,821,092 | B1 | 11/2004 | Gehret et al. |
| 6,828,579 | B2 | 12/2004 | Ghamaty et al. |
| 6,845,622 | B2 | 1/2005 | Sauciuc et al. |
| 6,855,880 | B2 | 2/2005 | Feher |
| 6,857,276 | B2 | 2/2005 | Finn et al. |
| 6,893,902 | B2 | 5/2005 | Cordes et al. |
| 6,894,215 | B2 | 5/2005 | Akiba |
| 6,895,762 | B1 | 5/2005 | Lin |
| 6,941,761 | B2 | 9/2005 | Gatecliff et al. |
| 6,951,113 | B1 | 10/2005 | Adamski |
| 7,000,407 | B2 | 2/2006 | Miozza et al. |
| 7,007,501 | B2 * | 3/2006 | Hu ..... 62/435 |
| 7,022,553 | B2 | 4/2006 | Ahn et al. |
| 7,026,712 | B2 | 4/2006 | Hayashi et al. |
| 7,032,389 | B2 | 4/2006 | Cauchy |
| 2001/0005990 | A1 | 7/2001 | Kim et al. |
| 2001/0013224 | A1 | 8/2001 | Ohkubo et al. |
| 2001/0052234 | A1 | 12/2001 | Venkatasubramanian |
| 2001/0052357 | A1 | 12/2001 | Kajihara et al. |
| 2002/0024154 | A1 | 2/2002 | Hara et al. |
| 2002/0038550 | A1 | 4/2002 | Gillen |
| 2002/0046762 | A1 | 4/2002 | Rossi |
| 2002/0059951 | A1 | 5/2002 | Tauchi et al. |
| 2002/0062853 | A1 | 5/2002 | Kajihara et al. |
| 2002/0062855 | A1 | 5/2002 | Chu et al. |
| 2002/0063327 | A1 | 5/2002 | Chu et al. |
| 2002/0083716 | A1 | 7/2002 | Ko |
| 2002/0100499 | A1 | 8/2002 | Hayashi et al. |
| 2002/0121095 | A1 | 9/2002 | Adamski et al. |
| 2002/0121096 | A1 | 9/2002 | Harrison et al. |
| 2002/0149896 | A1 | 10/2002 | Tauchi et al. |
| 2002/0162339 | A1 | 11/2002 | Harrison et al. |
| 2002/0170296 | A1 | 11/2002 | Guo et al. |
| 2002/0179135 | A1 | 12/2002 | Shutoh et al. |
| 2002/0184894 | A1 | 12/2002 | Batchelor et al. |
| 2003/0024565 | A1 | 2/2003 | Guy |
| 2003/0029173 | A1 | 2/2003 | Bell et al. |
| 2003/0029175 | A1 | 2/2003 | Lee |
| 2003/0056819 | A1 | 3/2003 | Imai et al. |
| 2003/0057560 | A1 | 3/2003 | Tatoh et al. |
| 2003/0066554 | A1 | 4/2003 | Feher |
| 2003/0097845 | A1 | 5/2003 | Saunders et al. |
| 2003/0102554 | A1 | 6/2003 | Chu et al. |
| 2003/0115892 | A1 | 6/2003 | Fu et al. |
| 2003/0121540 | A1 | 7/2003 | Onoue |
| 2003/0122245 | A1 | 7/2003 | Chu et al. |
| 2003/0126865 | A1 | 7/2003 | Venkatasubramanian |
| 2003/0131609 | A1 | 7/2003 | Venkatasubramanian |
| 2003/0140957 | A1 | 7/2003 | Akiba |
| 2003/0145605 | A1 | 8/2003 | Moon et al. |
| 2003/0154726 | A1 | 8/2003 | Finn et al. |
| 2003/0183839 | A1 | 10/2003 | Yamashita et al. |
| 2003/0188538 | A1 | 10/2003 | Chu et al. |
| 2003/0193087 | A1 | 10/2003 | Hayashi et al. |
| 2003/0214031 | A1 | 11/2003 | Onoue |
| 2003/0230332 | A1 | 12/2003 | Venkatasubramanian et al. |
| 2003/0234037 | A1 | 12/2003 | Tanaka |
| 2004/0042181 | A1 | 3/2004 | Nagasaki |
| 2004/0128041 | A1 | 7/2004 | Hiller et al. |
| 2004/0177876 | A1 | 9/2004 | Hightower |
| 2004/0177877 | A1 | 9/2004 | Hightower |
| 2004/0187501 | A1 | 9/2004 | Sauciuc et al. |
| 2004/0207037 | A1 | 10/2004 | Kucherov et al. |
| 2004/0231339 | A1 | 11/2004 | Miozza et al. |
| 2004/0238022 | A1 | 12/2004 | Hiller et al. |
| 2005/0000559 | A1 | 1/2005 | Horio et al. |
| 2005/0028858 | A1 | 2/2005 | Rossi |
| 2005/0029637 | A1 | 2/2005 | Hu et al. |
| 2005/0039465 | A1 | 2/2005 | Welch |
| 2005/0056310 | A1 | 3/2005 | Shikata et al. |
| 2005/0094381 | A1 | 5/2005 | Imamura et al. |
| 2005/0121065 | A1 | 6/2005 | Otey |
| 2005/0126184 | A1 | 6/2005 | Cauchy |
| 2005/0126185 | A1 | 6/2005 | Joshi |
| 2005/0139249 | A1 | 6/2005 | Ueki et al. |
| 2005/0139251 | A1 | 6/2005 | Shutoh et al. |
| 2005/0146060 | A1 | 7/2005 | Suzuki |
| 2005/0146850 | A1 | 7/2005 | Meir |
| 2005/0172991 | A1 | 8/2005 | Arai et al. |
| 2005/0204748 | A1 | 9/2005 | Yamanaka et al. |
| 2005/0241690 | A1 | 11/2005 | Tajima et al. |
| 2005/0247337 | A1 | 11/2005 | Chen et al. |
| 2005/0279104 | A1 | 12/2005 | Leija et al. |
| 2005/0279105 | A1 | 12/2005 | Pastorino |
| 2006/0000221 | A1 | 1/2006 | Culp et al. |
| 2006/0000500 | A1 | 1/2006 | Sauciuc et al. |
| 2006/0005873 | A1 | 1/2006 | Kambe et al. |
| 2006/0033206 | A1 | 2/2006 | Adar et al. |
| 2006/0048807 | A1 | 3/2006 | Lee et al. |
| 2006/0053805 | A1 | 3/2006 | Flinner et al. |
| 2006/0075761 | A1 | 4/2006 | Kitchens et al. |
| 2006/0086118 | A1 | 4/2006 | Venkatasubramanian et al. |
| 2006/0090787 | A1 | 5/2006 | Onvural |
| 2006/0096300 | A1 | 5/2006 | Reinstein et al. |
| 2006/0117761 | A1 | 6/2006 | Bormann |
| 2006/0118160 | A1 | 6/2006 | Funahashi et al. |

FOREIGN PATENT DOCUMENTS

| | | | |
|---|---|---|---|
| EP | 0 566 646 | B1 | 6/2000 |
| EP | 0 759 141 | B1 | 4/2003 |
| JP | 62-169981 | A | 7/1987 |
| JP | 62-182562 | A | 8/1987 |
| JP | 2000-304396 | A | 11/2000 |
| KR | 10-2000-0010150 | A | 2/2000 |
| WO | WO 92/13243 | | 8/1992 |
| WO | WO 95/31688 | | 11/1995 |
| WO | WO 99/26996 | | 6/1999 |
| WO | WO 01/25711 | A1 | 4/2001 |

* cited by examiner

REFRIGERATION SYSTEM INCLUDING THERMOELECTRIC MODULE

FIELD

The present teachings relate to refrigeration systems and, more particularly, to refrigeration systems that include a thermoelectric module.

BACKGROUND

Refrigeration systems incorporating a vapor compression cycle can be utilized for single-temperature applications, such as a freezer or refrigerator having one or more compartments that are to be maintained at a similar temperature, and for multi-temperature applications, such as refrigerators having multiple compartments that are to be kept at differing temperatures, such as a lower temperature (freezer) compartment and a medium or higher temperature (fresh food storage) compartment.

The vapor compression cycle utilizes a compressor to compress a working fluid (e.g., refrigerant) along with a condenser, an evaporator and an expansion device. For multi-temperature applications, the compressor is typically sized to run at the lowest operating temperature for the lower temperature compartment. As such, the compressor is typically sized larger than needed, resulting in reduced efficiency. Additionally, the larger compressor may operate at a higher internal temperature such that an auxiliary cooling system for the lubricant within the compressor may be needed to prevent the compressor from burning out.

To address the above concerns, refrigeration systems may use multiple compressors along with the same or different working fluids. The use of multiple compressors and/or multiple working fluids, however, may increase the cost and/or complexity of the refrigeration system and may not be justified based upon the overall efficiency gains.

Additionally, in some applications, the compressor and/or refrigerant that can be used may be limited based on the temperature that is to be achieved. For example, with an open drive shaft compressor, the seal along the drive shaft is utilized to maintain the working fluid within the compressor. When a working fluid, such as R134A, is utilized with an open drive shaft sealed compressor, the minimum temperature that can be achieved without causing leaks past the drive shaft seal is limited. That is, if too low a temperature were attempted to be achieved, a vacuum may develop such that ambient air may be pulled into the interior of the compressor and contaminate the system. To avoid this, other types of compressors and/or working fluids may be required. These other types of compressors and/or working fluids, however, may be more expensive and/or less efficient.

Additionally, the refrigeration systems may require a defrost cycle to thaw out any ice that has accumulated or formed on the evaporator. Traditional defrost systems utilize an electrically powered radiant heat source that is selectively operated to heat the evaporator and melt the ice that is formed thereon. Radiant heat sources, however, are inefficient and, as a result, increase the cost of operating the refrigeration system and add to the complexity. Hot gas from the compressor may also be used to defrost the evaporator. Such systems, however, require additional plumbing and controllers and, as a result, increase the cost and complexity of the refrigeration system.

SUMMARY

A refrigeration system may be used to meet the temperature/load demands of both multi-temperature and single-temperature applications. The refrigeration system may include a vapor compression (refrigeration) circuit and a liquid heat-transfer circuit in heat-transferring relation with one another through one or more thermoelectric devices. The refrigeration system may stage the cooling with the vapor compression circuit providing a second stage of cooling and the thermoelectric device in conjunction with the heat-transfer circuit providing the first stage of cooling. The staging may reduce the load imparted on a single compressor and, thus, allows a smaller, more efficient compressor to be used. Additionally, the reduced load on the compressor may allow a greater choice in the type of compressor and/or refrigerant utilized. Moreover, the operation of the thermoelectric device may be reversed to provide a defrost function.

First and second sides of a thermoelectric device may be in heat-transferring relation with a compressible working fluid flowing through a refrigeration circuit and a heat-transfer fluid flowing through a heat-transfer circuit, respectively. The thermoelectric device forms a temperature gradient between the compressible working fluid and heat-transfer fluid, which allows heat to be extracted from one of the compressible working fluid and the heat-transfer fluid and transferred to the other through the thermoelectric device.

The refrigeration system may include a thermoelectric device in heat-transferring relation with a heat-transfer circuit and a vapor compression circuit. The heat-transfer circuit may transfer heat between a heat-transfer fluid flowing therethrough and a first refrigerated space. The vapor compression circuit may transfer heat between a refrigerant flowing therethrough and an airflow. The thermoelectric device transfers heat between the heat-transfer fluid and the refrigerant.

Methods of operating refrigeration systems having a vapor compression circuit, a heat-transfer circuit and a thermoelectric device include transferring heat between a heat-transfer fluid flowing through the heat-transfer circuit and a first side of the thermoelectric device and transferring heat between a refrigerant flowing through the vapor compression circuit and a second side of the thermoelectric device.

Further, the refrigeration system may be operated in a cooling mode including transferring heat from the heat-transfer circuit to the thermoelectric device and transferring heat from the thermoelectric device to the refrigeration circuit. Also, the refrigeration system may be operated in a defrost mode including transferring heat through the thermoelectric device to the heat-transfer circuit and defrosting the heat exchanger with a heat-transfer fluid flowing through the heat-transfer circuit. The refrigeration system may be operated by selectively switching between the cooling mode and the defrost mode.

A method of conditioning a space with a refrigeration system includes forming a first heat sink for a first side of a thermoelectric device with a vapor compression cycle and forming a second heat sink for a heat-transfer fluid flow with a second side of the thermoelectric device. Heat may be transferred from the heat-transfer fluid flow to a refrigerant in the vapor compression cycle through the thermoelectric device to thereby condition the space.

Further areas of applicability of the present teachings will become apparent from the detailed description provided hereinafter. It should be understood that the detailed description and specific examples are intended for purposes of illustration only and are not intended to limit the scope of the teachings.

BRIEF DESCRIPTION OF THE DRAWINGS

The present teachings will become more fully understood from the detailed description and the accompanying drawings, wherein.

DETAILED DESCRIPTION

The following description is merely exemplary in nature and is in no way intended to limit the teachings, their application, or uses. In describing the various teachings herein, reference indicia are used. Like reference indicia are used for like elements. For example, if an element is identified as 10 in one of the teachings, a like element in subsequent teachings may be identified as 110, 210, etc. As used herein, the term "heat-transferring relation" refers to a relationship that allows heat to be transferred from one medium to another medium and includes convection, conduction and radiant heat transfer.

Figure 1:
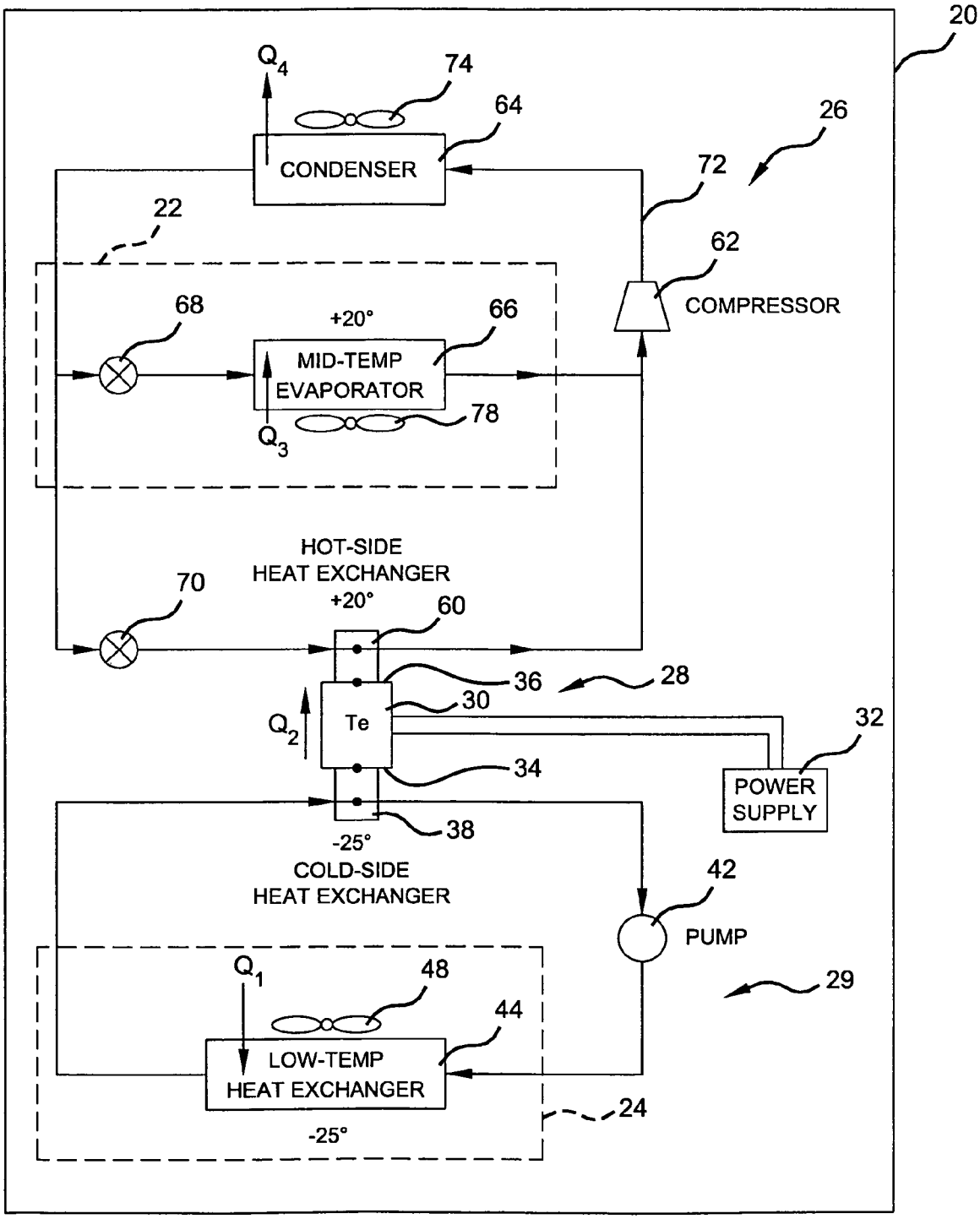
FIG. 1 is a schematic diagram of a refrigeration system according to the present teachings.

Referring now to FIG. 1, a refrigeration system 20 is a multi-temperature system having a first compartment or refrigerated space (hereinafter compartment) 22 designed to be maintained at a first temperature and a second compartment or refrigerated space (hereinafter compartment) 24 designed to be maintained at a lower temperature than the first compartment 22. For example, refrigeration system 20 can be a commercial or residential refrigerator with first compartment 22 being a medium-temperature compartment designed for fresh food storage while second compartment 24 is a low-temperature compartment designed for frozen food storage. Refrigeration system 20 is a hybrid or combination system which uses a vapor compression cycle or circuit (VCC) 26, a thermoelectric module (TEM) 28 and a heat-transfer circuit 29 to cool compartments 22, 24 and maintain a desired temperature therein. TEM 28 and heat-transfer circuit 29 maintain second compartment 24 at the desired temperature while VCC 26 maintains first compartment 22 at the desired temperature and absorbs the waste heat from TEM 28. VCC 26, TEM 28 and heat-transfer circuit 29 are sized to meet the heat loads of first and second compartments 22, 24.

TEM 28 includes one or more thermoelectric elements or devices 30 in conjunction with heat exchangers to remove heat from the heat-transfer fluid flowing through heat-transfer circuit 29 and direct the heat into the refrigerant flowing through VCC 26. The thermoelectric devices 30 are connected to a power supply 32 that selectively applies DC current (power) to each thermoelectric device 30. Thermoelectric devices 30 convert electrical energy from power supply 32 into a temperature gradient, known as the Peltier effect, between opposing sides of each thermoelectric device 30. Thermoelectric devices can be acquired from various suppliers. For example, Kryotherm USA of Carson City, Nev. is a source for thermoelectric devices. Power supply 32 may vary or modulate the current flow to thermoelectric devices 30.

The current flow through the thermoelectric devices 30 results in each thermoelectric device 30 having a relatively lower temperature or cold side 34 and a relatively higher temperature or hot side 36 (hereinafter referred to as cold side and hot side). It should be appreciated that the terms "cold side" and "hot side" may refer to specific sides, surfaces or areas of the thermoelectric devices. Cold side 34 is in heat-transferring relation with heat-transfer circuit 29 while hot side 36 is in heat-transferring relation with VCC 26 to transfer heat from heat-transfer circuit 29 to VCC 26.

Cold side 34 of thermoelectric device 30 is in heat-transferring relation with a heat exchange element 38 and forms part of heat-transfer circuit 29. Heat-transfer circuit 29 includes a fluid pump 42, heat exchanger 44 and TEM 28 (thermoelectric device 30 and heat exchange element 38). A heat-transfer fluid flows through the components of heat-transfer circuit 29 to remove heat from second compartment 24. Heat-transfer circuit 29 may be a single-phase fluid circuit in that the heat-transfer fluid flowing therethrough remains in the same phase throughout the circuit. A variety of single-phase fluids may be used within heat transfer circuit 29. By way of non-limiting example, the single-phase fluid may be potassium formate or other types of secondary heat transfer fluids, such as those available from Environmental Process Systems Limited of Cambridgeshire, UK and sold under the Tyfo® brand, and the like.

Pump 42 pumps the heat-transfer fluid through the components of heat-transfer circuit 29. The heat-transfer fluid flowing through heat exchange element 38 is cooled therein via the thermal contact with cold side 34 of thermoelectric device 30. Heat exchange element 38 functions to facilitate thermal contact between the heat-transfer fluid flowing through heat-transfer circuit 29 and the cold side 34 of thermoelectric device 30. The heat-transfer may be facilitated by increasing the heat-transferring surface area that is in contact with the heat-transfer fluid. One type of heat exchange element 38 that may possibly accomplish this includes micro-channel tubing that is in thermal contact with cold side 34 of each thermoelectric device 30 and having channels through which the heat-transfer fluid flows. The thermal contact with cold side 34 lowers the temperature, by way of non-limiting example to −25° F., of the heat-transfer fluid flowing through heat exchange element 38 by extracting heat therefrom. The heat-transfer fluid exits heat exchange element 38 and flows through pump 42.

From pump 42, the heat transfer fluid flows through heat exchanger 44 at an initial ideal temperature of −25° F., by way of non-limiting example. A fan 48 circulates air within second compartment 24 over evaporator 44. Heat $Q_1$ is extracted from the heat load and transferred to the heat-transfer fluid flowing through heat exchanger 44. The heat-transfer fluid exits heat exchanger 44 and flows through heat exchange element 38 to discharge the heat $Q_1$, extracted from the air flow that flows through second compartment 24, to VCC 26.

Heat flows through thermoelectric devices 30 from cold side 34 to hot side 36. To facilitate the removal of heat from hot side 36 TEM 28 includes another heat exchange element 60 in thermal contact with hot side 36 of each thermoelectric device 30. Heat exchange element 60 forms part of VCC 26 and moves the heat extracted from the air flow that flows through second compartment 24 into the refrigerant flowing therethrough. Heat exchange element 60 can take a variety of forms. Heat exchange element 60 functions to facilitate heat-transfer between hot side 36 of thermoelectric devices 30 and the refrigerant flowing through VCC 26. Increasing the thermally conductive surface area in contact with the refrigerant flowing through heat exchange element 60 facilitates the transfer of heat therebetween. One possible form of heat exchange element 60 that may accomplish this includes a micro-channel tubing that is in thermal contact with hot side 36 of each thermoelectric device 30. The thermal contact increases the temperature of the refrigerant flowing through heat exchange element 60.

Power supply 32 is operated to provide a current through thermoelectric devices 30 in order to maintain a desired temperature gradient, such as by way of non-limiting example $\Delta T=45°$ F., across thermoelectric devices 30. The electric current flowing through thermoelectric devices 30 generates heat therein (i.e., Joule heat). Therefore, the total heat $Q_2$ to be transferred by thermoelectric devices 30 into the refrigerant flowing through heat exchange element 60 is the sum of the Joule heat plus the heat being extracted from the heat-transfer fluid through cold side 34 (the heat $Q_1$ extracted from the air flow that flows through second compartment 24).

VCC 26 includes a compressor 62, a condenser 64, an evaporator 66 and first and second expansion devices 68, 70, along with heat exchange element 60. These components of VCC 26 are included in a refrigeration circuit 72. A refrigerant, such as by way of non-limiting example R134A or R404A, flows through refrigeration circuit 72 and the components of VCC 26 to remove heat from first compartment 22 and from TEM 28. The specific type of compressor 62 and refrigerant used may vary based on the application and the demands thereof.

Compressor 62 compresses the refrigerant supplied to condenser 64, which is disposed outside of first compartment 22. A fan 74 blows ambient air across condenser 64 to extract heat $Q_4$ from the refrigerant flowing through condenser 64, whereby the refrigerant exiting condenser 64 has a lower temperature than the refrigerant entering condenser 64. A portion of the refrigerant flows from condenser 64 to evaporator 66 and the remaining refrigerant flows to heat exchange element 60. First expansion device 68 controls the quantity of refrigerant flowing through evaporator 66, while second expansion device 70 controls the quantity of refrigerant flowing through heat exchange element 60. Expansion devices 68, 70 can take a variety of forms. By way of non-limiting example, expansion devices 68, 70 can be thermostatic expansion valves, capillary tubes, micro valves, and the like.

A fan 78 circulates air within first compartment 22 over evaporator 66. Evaporator 66 extracts heat $Q_3$ from the air flow and transfers the heat $Q_3$ to the refrigerant flowing therethrough. The temperature of the refrigerant exiting evaporator 66 may be, by way of non-limiting example, 20° F.

The refrigerant flowing through heat exchange element 60 extracts the heat $Q_2$ from thermoelectric devices 30 and facilitates maintaining of hot side 36 of thermoelectric devices 30 at a desired temperature, such as by way of non-limiting example 20° F. The refrigerant flowing through heat exchange element 60 ideally exits at the same temperature as hot side 36.

Refrigerant exiting evaporator 66 and heat exchange element 60 flow back into compressor 62. The refrigerant then flows through compressor 62 and begins the cycle again. Evaporator 66 and heat exchange element 60 may be configured, arranged and controlled to operate at approximately the same temperature, such as by way of non-limiting example 20° F. That is, the refrigerant flowing therethrough would exit the evaporator 66 and heat exchange element 60 at approximately the same temperature. As such, expansion devices 68, 70 adjust the flow of refrigerant therethrough to correspond to the demands placed upon evaporator 66 and heat exchange element 60. Thus, such an arrangement provides simple control of the refrigerant flowing through VCC 26.

First and second expansion devices 68, 70 may also be replaced with a single expansion device which is located within circuit 72 upstream of where the refrigerant flow is separated to provide refrigerant flow to evaporator 66 and heat exchange element 60. Additionally, expansion devices 68, 70 may be controlled in unison or separately, as desired, to provide desired refrigerant flows through evaporator 66 and heat exchange element 60.

Figure 2:
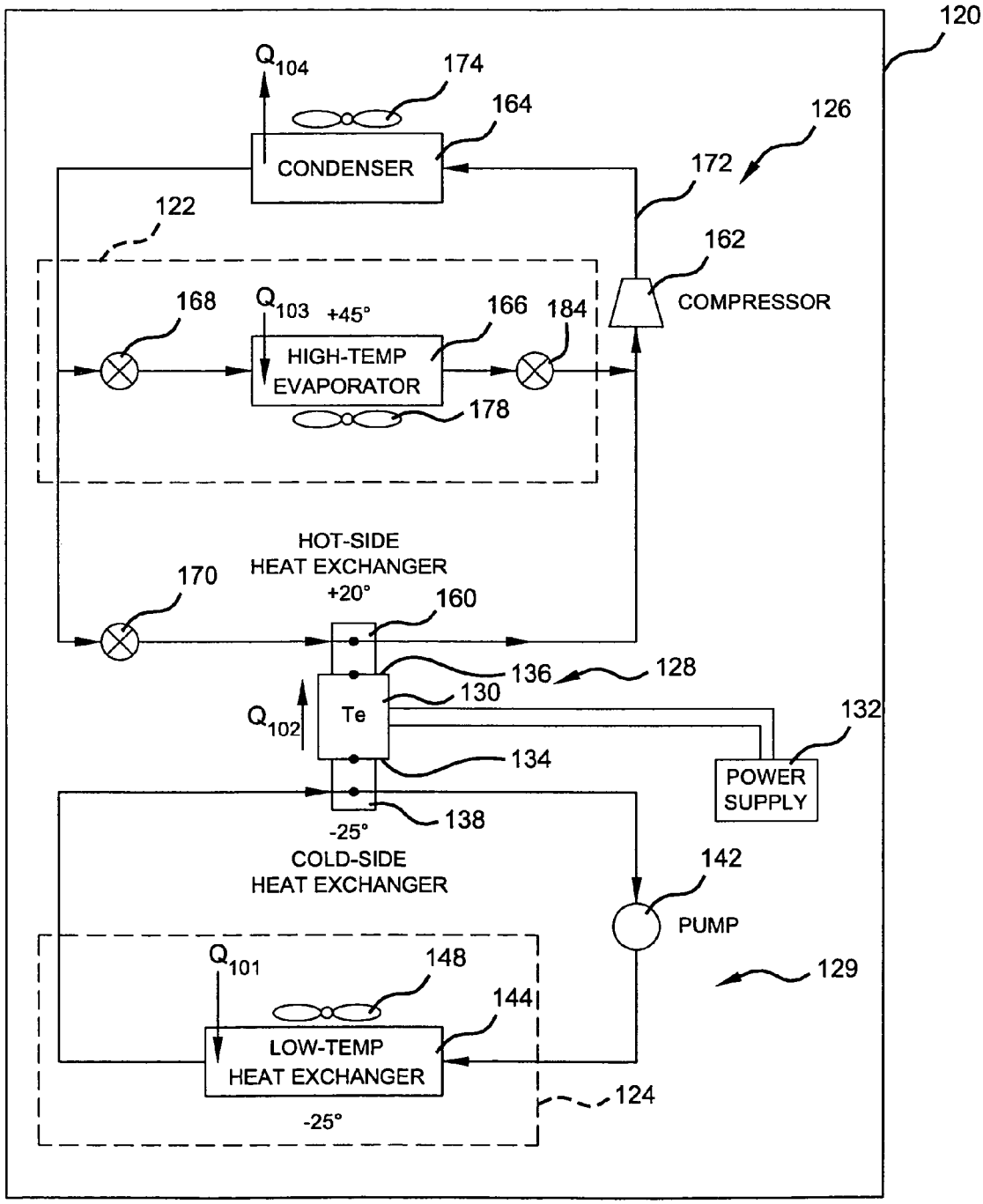
FIG. 2 is a schematic diagram of a refrigeration system according to the present teachings.

Referring now to FIG. 2, a refrigeration system 120 is shown similar to refrigeration system 20, but including an evaporator 166 designed to be operated at a higher-temperature, such as by way of non-limiting example 45° F., and does not operate at a temperature generally similar to heat exchange element 160. A pressure regulating device 184 may be disposed downstream of evaporator 166 at a location prior to the refrigerant flowing therethrough joining with the refrigerant flowing through heat exchange element 160. Pressure regulating device 184 controls the refrigerant pressure immediately downstream of evaporator 166. Pressure regulating device 184 may be operated to create a pressure differential across the coils of evaporator 166, thereby allowing evaporator 166 to be operated at a temperature different than that of heat exchange element 60. By way of non-limiting example, heat exchange element 60 may be operated at 20° F. while evaporator 166 is operated at 45° F. Pressure regulating device 184 also provides a downstream pressure generally similar to that of the refrigerant exiting heat exchange element 60, and compressor 162 still receives refrigerant at a generally similar temperature and pressure.

In sum, VCC 126 includes an evaporator 166 and heat exchange element 160 that are operated in parallel and at different temperatures. Thus, in refrigeration system 120, a single compressor serves multiple temperature loads (heat exchange element 160 and evaporator 166).

The use of both a vapor compression cycle along with a thermoelectric device or module and heat-transfer circuit 29 capitalizes on the strengths and benefits of each while reducing the weaknesses associated with systems that are either entirely vapor compression cycle systems or entirely thermoelectric module systems. That is, by using a thermoelectric module with heat-transfer circuit 29 to provide the temperature for a particular compartment, a more efficient refrigeration system can be obtained with thermoelectric modules that have a lower level of efficiency (ZT). For example, in a multi-temperature application system that relies entirely upon thermoelectric modules, a higher ZT value is required than when used in a system in conjunction with a vapor compression cycle. With the use of a vapor compression cycle, a thermoelectric module with a lower ZT can be utilized while providing an overall system that has a desired efficiency. Additionally, such systems may be more cost effective than the use of thermoelectric modules only.

Thus, the use of a system incorporating both a vapor compression cycle, thermoelectric modules and a heat-transfer circuit to provide a refrigeration system for multi-temperature applications may be advantageously employed over existing systems. Additionally, the use of a thermoelectric module is advantageous in that they are compact, solid state, have an extremely long life span, a very quick response time, do not require lubrication and have a reduced noise output over a vapor compression cycle. Moreover, the use of thermoelectric modules for portions of the refrigeration system also eliminates some of the vacuum issues associated with the use of particular types of compressors for low temperature refrigeration. Accordingly, the refrigeration system utilizing a vapor compression cycle, thermoelectric modules and a heat-transfer circuit may be employed to meet the demands of a multi-temperature application.

Figure 3:
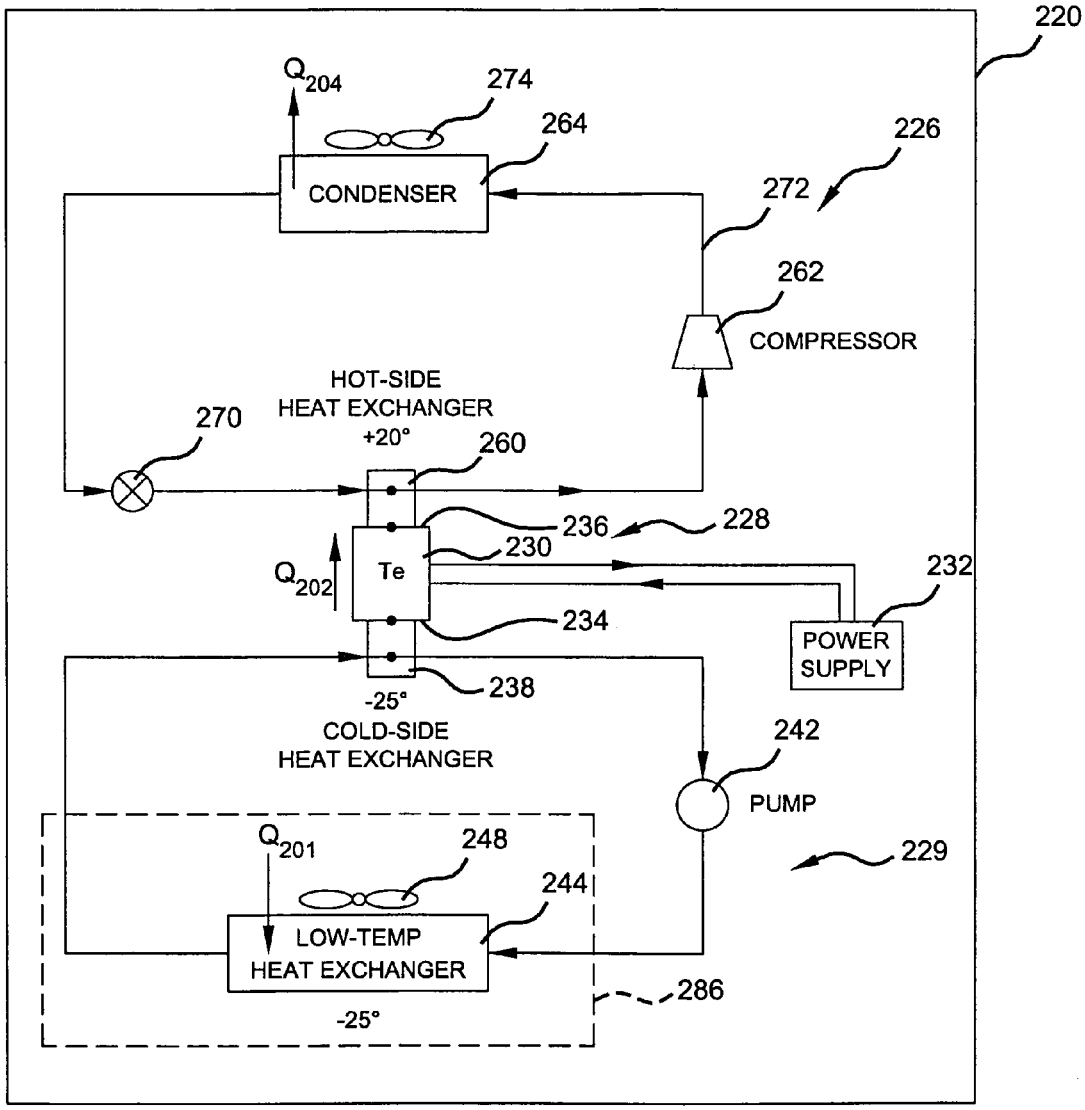
FIG. 3 is a schematic diagram of a refrigeration system according to the present teachings.

Referring now to FIG. 3, a refrigeration system 220 is used for a single-temperature application. Refrigeration system 220 utilizes a vapor compression cycle 226 in conjunction with a thermoelectric module 228 and heat-transfer circuit 229 to maintain a compartment or refrigerated space (hereinafter compartment) 286 at a desired temperature. By way of non-limiting example, compartment 286 can be a low-temperature compartment that operates at −25° F. or can be a cryogenic compartment that operates at −60° F.

Refrigeration system 220 stages the heat removal from compartment 286. A first stage of heat removal is performed by heat-transfer circuit 229 and TEM 228. The second stage of heat removal is performed by VCC 226 in conjunction with TEM 228. Heat-transfer circuit 229 utilizes a heat-transfer fluid that flows through heat exchange element 238, which is in heat conductive contact with cold side 234 of thermoelectric devices 230. Fluid pump 242 causes the heat-transfer fluid to flow through heat-transfer circuit 229.

Heat-transfer fluid leaving heat exchange element 238 is cooled (has heat removed) by the heat-transferring relation with cold side 234 of thermoelectric devices 230. The cooled heat-transfer fluid flows through pump 242 and into heat exchanger 244. Fan 248 causes air within compartment 286 to flow across heat exchanger 244. Heat exchanger 244 extracts heat $Q_{201}$ from the air flow and transfers it to the heat-transfer fluid flowing therethrough. The heat-transfer fluid then flows back into heat exchange element 238 wherein the heat $Q_{201}$ is extracted from the heat-transfer fluid by TEM 228.

DC current is selectively supplied to TEM 228 by power supply 232. The current flow causes thermoelectric devices 230 within TEM 228 to produce a temperature gradient between cold side 234 and hot side 236. The temperature gradient facilitates the transferring of heat from the heat-transfer fluid flowing through heat-transfer circuit 229 into the refrigerant flowing through VCC 226. Heat $Q_{202}$ flows from heat exchange element 260 into the refrigerant flowing therethrough. Heat $Q_{202}$ includes the heat extracted from the heat-transfer fluid flowing through heat exchange element 238 along with the Joule heat produced within thermoelectric devices 230.

The refrigerant exiting heat exchange element 260 flows through compressor 262 and on to condenser 264. Fan 274 provides a flow of ambient air across condenser 264 to facilitate the removal of heat $Q_{204}$ from the refrigerant flowing therethrough. The refrigerant exiting condenser 264 flows through an expansion device 270 and then back into heat exchange element 260. VCC 226 thereby extracts heat $Q_{202}$ from TEM 228 and expels heat $Q_{204}$ to the ambient environment.

Compressor 262 and expansion device 270 are sized to meet the heat removal needs of TEM 228. The power supplied to thermoelectric devices 230 by power supply 232 is modulated to maintain a desired temperature gradient between hot and cold sides 236, 234. Pump 242 can vary the flow rate of the heat-transfer fluid flowing therethrough to provide the desired heat removal from compartment 286.

With this configuration, refrigeration system 220 allows compressor 262 to be smaller than that required in a single-stage refrigeration system. Additionally, by staging the heat removal, compressor 262 and the refrigerant flowing therethrough can be operated at a higher temperature than that required with a single stage operation, which enables the use of a greater variety of compressors and/or different refrigerants. Additionally, the higher temperature enables a more efficient vapor compression cycle to be utilized while still achieving the desired low temperature within compartment 286 through the use of TEM 228 and heat-transfer circuit 229. The enhanced efficiency is even more pronounced in cryogenic applications, such as when compartment 286 is maintained at a cryogenic temperature, such as −60° F.

Staging also avoids some of the overheating issues associated with using a single-stage refrigeration system and a compressor sized to meet that cooling load. For example, to meet the cooling load with a single-stage vapor compression cycle, the compressor may need to be run at a relatively high temperature that might otherwise cook the compressor or cause the lubricant therein to break down. The use of TEM 228 and heat-transfer circuit 229 avoids these potential problems by allowing compressor 262 to be sized to maintain a relatively high temperature and then meeting a relatively low-temperature cooling load through the use of TEM 228 and heat-transfer circuit 229. The use of a smaller compressor 262 may also increase the efficiency of the compressor and, thus, of VCC 226.

Figure 4:
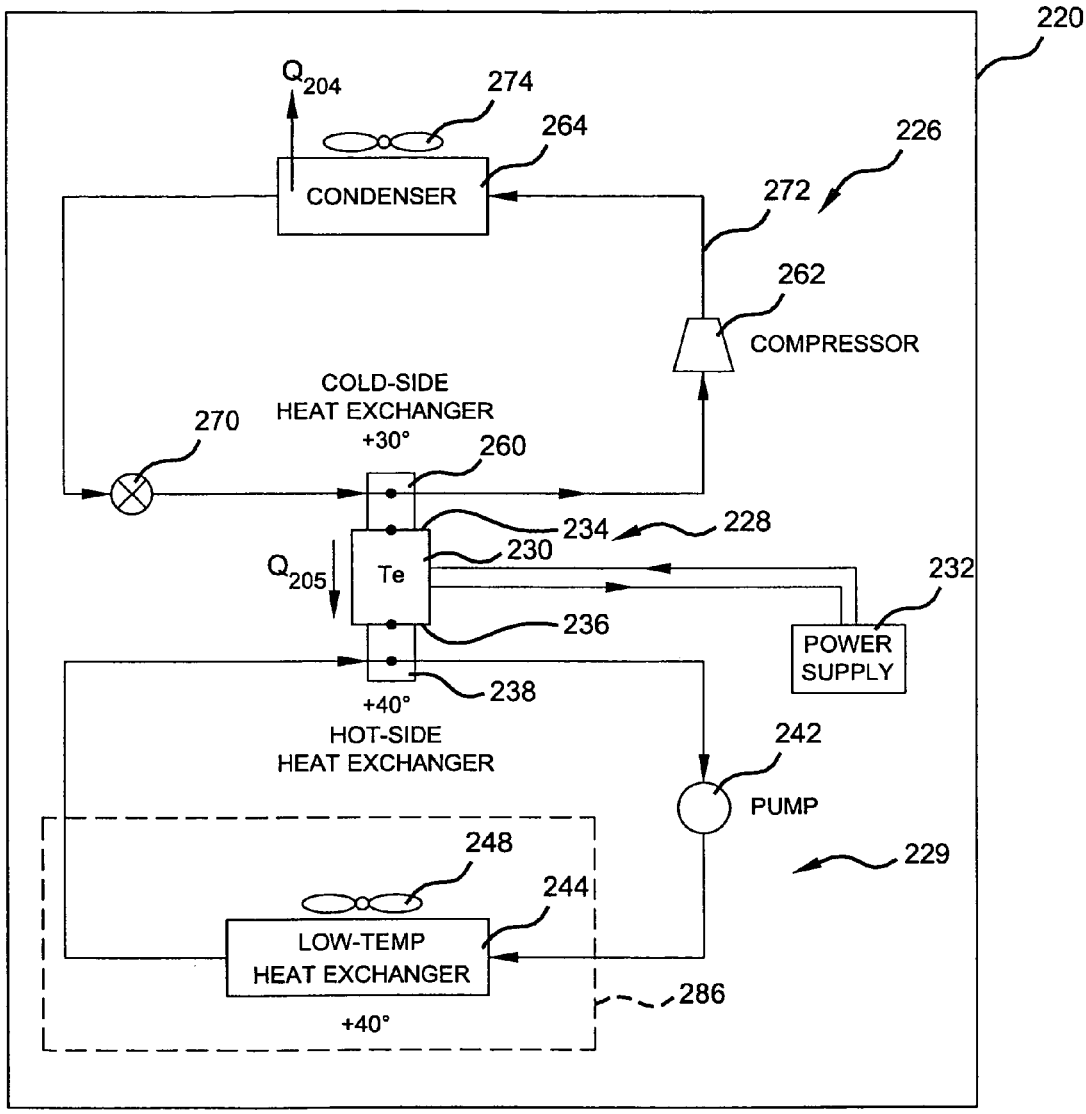
FIG. 4 is a schematic diagram of the refrigeration system of FIG. 3 operating in a defrost mode.

Referring now to FIG. 4, refrigeration system 220 is shown operating in a defrost mode, which allows defrosting of heat exchanger 244 without the use of a radiant electrical heating element or a hot gas defrost. Additionally, the system facilitates the defrosting by allowing the elevated temperature of heat exchanger 244 to be achieved quickly and efficiently.

To defrost heat exchanger 244, VCC 226 is operated so that heat exchange element 260 is operated at a relatively higher temperature, such as 30° F. The polarity of the current being supplied to thermoelectric devices 230 is reversed so that the hot and cold sides 234, 236 are reversed from that shown during the normal (cooling) operation (FIG. 3). With the polarity reversed, heat flow $Q_{205}$ will travel from heat exchange element 260 toward heat exchange element 238 and enter into the heat transfer fluid flowing through heat exchange element 238. The power supplied to thermoelectric devices 30 can be modulated to minimize the temperature gradient across thermoelectric devices 230. For example, the power supply can be modulated to provide a 10° F. temperature gradient between cold side 234 and hot side 236.

The heated heat transfer fluid exiting heat exchange element 238 flows through fluid pump 242 and into heat exchanger 244. Fan 248 is turned off during the defrost cycle. The relatively warm heat transfer fluid flowing through heat exchanger 244 warms heat exchanger 244 and melts or defrosts any ice buildup on heat exchanger 244. By not operating fan 248, the impact of the defrost cycle on the temperature of the food or products being stored within compartment 286 is minimized. The heat transfer fluid exits heat exchanger 244 and flows back into heat exchange element 238 to again be warmed up and further defrost heat exchanger 244.

Thus, refrigeration system 220 may be operated in a normal mode to maintain compartment 286 at a desired temperature and operated in a defrost mode to defrost the heat exchanger associated with compartment 286. The system advantageously uses a combination of a vapor compression cycle along with a thermoelectric module and heat-transfer circuit to perform both operating modes without the need for radiant electrical heat or other heat sources to perform a defrosting operation.

Figure 5:
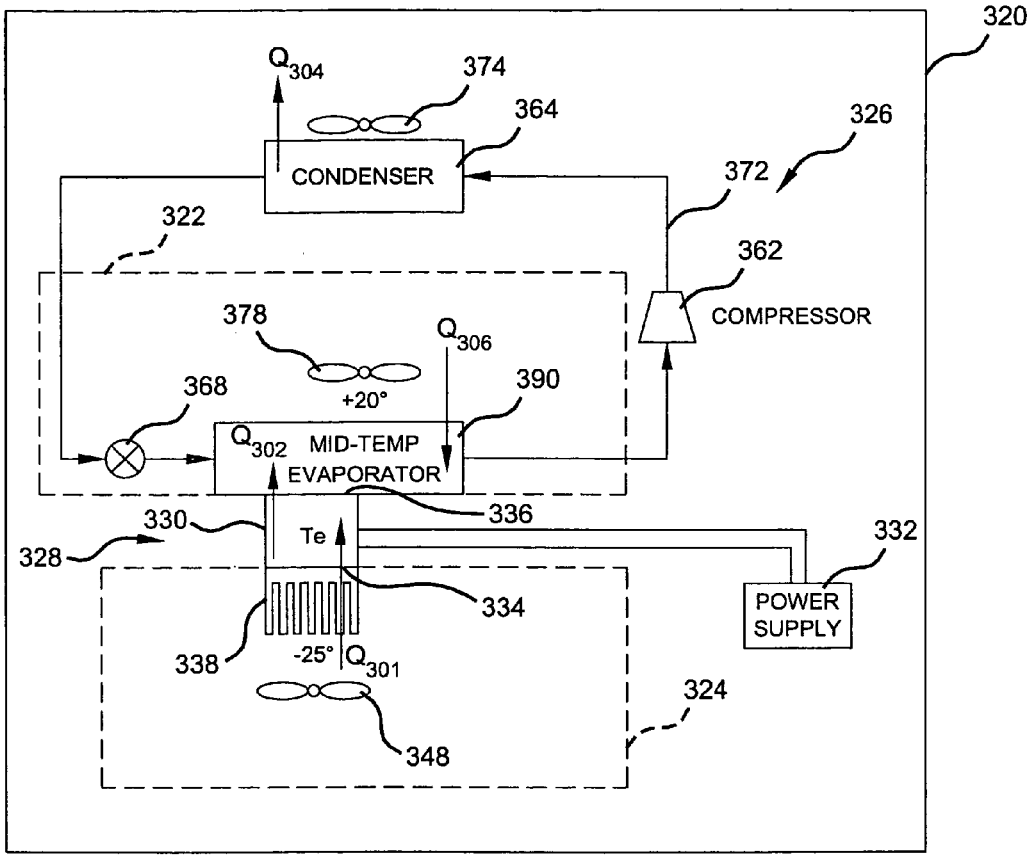
FIG. 5 is a schematic diagram of a refrigeration system according to the present teachings.

Referring now to FIG. 5, a refrigeration system 320 is shown similar to refrigeration system 20. In refrigeration system 320, there is no heat transfer circuit to cool second compartment 324. Rather, heat exchange element 338 is in the form of fins and fan 348 circulates air within second compartment 324 across the fins of heat exchange element 338. Heat $Q_{301}$ is extracted from the air flow and transferred to thermoelectric device 330. VCC 326 includes a single mid-temperature evaporator 390 that is in heat-transferring relation with hot side 336 of thermoelectric devices 330. In other words, evaporator 390 functions as the hot side heat exchange element of TEM 328.

Power supply 332 is operated to provide a current through thermoelectric devices 330 in order to maintain a desired temperature gradient, such as by way of non-limiting example $\Delta T=45°$ F., across thermoelectric devices 330. Electric current flowing through thermoelectric devices 330 generates heat therein (i.e., Joule heat). Therefore, the total heat $Q_{302}$ transferred by thermoelectric devices 330 into the refrigerant flowing through evaporator 390 is the sum of the Joule heat plus the heat $Q_{301}$ being extracted from the air flow flowing across heat exchange element 338. The heat-transferring relation between thermoelectric devices 330 and evaporator 390 allows heat $Q_{302}$ to be transferred to the working fluid flowing through evaporator 390. Evaporator 390 is also in heat-transferring relation with an air flow circulated thereacross and through first compartment 322 by fan 378. Heat $Q_{306}$ is transferred from the air flow to the working fluid flowing through evaporator 390 to condition first compartment 322.

Heat $Q_{304}$ is transferred from the working fluid flowing through VCC 326 to the air flow circulated by fan 374 across condenser 364. Thus, in refrigeration system 320, TEM 328 directly extracts heat $Q_{301}$ from the air circulating through second compartment 324 and transfers that heat to the working fluid flowing through evaporator 390 which is in heat-transferring relation with hot side 336. Evaporator 390 also serves to extract heat from the air circulating through first compartment 322.

While the present teachings have been described with reference to the drawings and examples, changes may be made without deviating from the spirit and scope of the present teachings. For example, a liquid suction heat exchanger (not shown) can be employed between the refrigerant flowing into the compressor and the refrigerant exiting the condenser to exchange heat between the liquid cooling side and the vapor superheating side. Moreover, it should be appreciated that the compressors utilized in the refrigeration system shown can be of a variety of types. For example, the compressors can be either internally or externally driven compressors and may include rotary compressors, screw compressors, centrifugal compressors, orbital scroll compressors and the like. Furthermore, while the condensers and evaporators are described as being coil units, it should be appreciated that other types of evaporators and condensers can be employed. Additionally, while the present teachings have been described with reference to specific temperatures, it should be appreciated these temperatures are provided as non-limiting examples of the capabilities of the refrigeration systems. Accordingly, the temperatures of the various components within the various refrigeration systems can vary from those shown.

Furthermore, it should be appreciated that the refrigeration systems shown may be used in both stationary and mobile applications. Moreover, the compartments that are conditioned by the refrigeration systems can be open or closed compartments or spaces. Additionally, the refrigeration systems shown may also be used in applications having more than two compartments or spaces that are desired to be maintained at the same or different temperatures. Moreover, it should be appreciated that the cascading of the vapor compression cycle, the thermoelectric module and the heat-transfer circuit can be reversed from that shown. That is, a vapor compression cycle can be used to extract heat from the lower temperature compartment while the thermoelectric module and a heat-transfer circuit can be used to expel heat from the higher temperature compartment although all of the advantages of the present teachings may not be realized. Additionally, it should be appreciated that the heat exchange devices utilized on the hot and cold sides of the thermoelectric devices may be the same or differ from one another. Moreover, with a single-phase fluid flowing through one of the heat exchange devices and a refrigerant flowing through the other heat exchange device, such configurations may be optimized for the specific fluid flowing therethrough. Moreover, it should be appreciated that the various teachings disclosed herein may be combined in combinations other than those shown. For example, the TEMs used in FIGS. 1-4 may incorporate fins on the cold side thereof with the fan blowing the air directly over the fins to transfer heat therefrom in lieu of the use of a heat-transfer circuit. Moreover, the TEMs may be placed in heat-transferring relation with a single evaporator that is in heat-transferring relation with both the TEM and the air flow flowing through the first compartment. Thus, the heat exchange devices on opposite sides of the thermoelectric devices can be the same or different from one another. Accordingly, the description is merely exemplary in nature and variations are not to be regarded as a departure from the spirit and scope of the teachings.

What is claimed is:

1. A refrigeration system comprising:

a thermoelectric device that forms a temperature gradient between first and second sides;

a compressible working fluid flowing through a refrigeration circuit in heat-transferring relation to said first side of said thermoelectric device;

a heat transfer fluid flowing through a heat-transfer circuit in heat-transferring relation to said second side of said thermoelectric device;

wherein heat is extracted from one of said compressible working fluid and heat transfer fluid and transferred to the other of said compressible working fluid and heat transfer fluid through said thermoelectric device.

2. The refrigeration system of claim 1, further comprising a compressor in said refrigeration circuit and wherein said compressible working fluid is compressed by said compressor.

3. The refrigeration system of claim 2, further comprising a condenser and an expansion device in said refrigeration circuit, said condenser operable to extract heat from said compressible working fluid.

4. The refrigeration system of claim 3, further comprising an evaporator in said refrigeration circuit in heat-transferring relation with a first air flow, wherein a first portion of said compressible working fluid flows in heat-transferring relation with said evaporator and a second portion of said compressible working fluid flows in heat-transferring relation with said first side of said thermoelectric device, such that said first and second portions flow in parallel in said refrigeration circuit.

5. The refrigeration system of claim 4, wherein said expansion device is a first expansion device and further comprising a second expansion device in said refrigeration circuit, said first and second expansion devices regulating the respective flow of said first and second portions of said compressible working fluid.

6. The refrigeration system of claim 4, further comprising a heat exchanger in said heat-transfer circuit in heat-transferring relation with a second air flow such that said heat-transfer fluid is in heat-transferring relation with both said second air flow and said second side of said thermoelectric device.

7. The refrigeration system of claim 6, further comprising:

a first space maintained at a first temperature and through which said first air flow travels;

a second space maintained at a second temperature different than said first space and through which said second air flow travels;

wherein said heat exchanger extracts heat from said second air flow and transfers said second air flow extracted heat to said heat-transfer fluid, said thermoelectric device transfers said second air flow extracted heat from said heat-transfer fluid to said second portion of said compressible working fluid, and said evaporator extracts heat from said first air flow and transfers said first air flow extracted heat to said first portion of said compressible working fluid.

8. The refrigeration system of claim 3, further comprising a heat exchanger in said heat-transfer circuit in heat-transferring relation with said heat-transfer fluid, said heat exchanger operable to transfer heat between said heat-transfer fluid and an air flow, wherein said expansion device regulates flow of said compressible working fluid.

9. The refrigeration system of claim 8, further comprising a space maintained at a predetermined temperature and through which said air flow travels, and wherein said heat exchanger extracts heat from said air flow and transfers said heat to said heat-transfer fluid, said thermoelectric device transfers said heat from said heat transfer fluid to said compressible working fluid, and said condenser transfers said heat to the ambient environment thereby maintaining said space at said predetermined temperature.

10. The refrigeration system of claim 1, wherein said heat-transfer fluid is a single-phase fluid in said heat-transfer circuit.

11. A refrigeration system comprising:

a heat-transfer circuit operable to transfer heat between a heat-transfer fluid flowing therethrough and a first refrigerated space;

a vapor compression circuit operable to transfer heat between a refrigerant flowing therethrough and an air flow;

a thermoelectric device in heat-transferring relation with said heat-transfer circuit and said vapor compression circuit, said thermoelectric device operable to transfer heat between said heat-transfer fluid and said refrigerant.

12. The refrigeration system of claim 11, wherein said heat-transfer circuit maintains said first refrigerated space at a first predetermined temperature and said heat-transfer circuit includes:

a fluid pump pumping said heat-transfer fluid through said heat-transfer circuit; and a heat exchanger transferring heat between said heat-transfer fluid and said first refrigerated space.

13. The refrigeration system of claim 12, wherein said vapor compression circuit includes:

a compressor compressing said refrigerant;

a condenser transferring heat between said refrigerant and said air flow; and an expansion device regulating flow of said refrigerant.

14. The refrigeration system of claim 13, wherein said vapor compression circuit maintains a second refrigerated space at a second predetermined temperature and said vapor compression circuit includes an evaporator transferring heat between said refrigerant and said second refrigerated space.

15. The refrigeration system of claim 14, wherein different portions of said refrigerant flow through said evaporator and in heat-transferring relation with said thermoelectric device and rejoin prior to flowing through said compressor.

16. The refrigeration system of claim 15, wherein said vapor compression circuit includes a pressure regulating device downstream of said evaporator and creating a pressure differential across said evaporator.

17. The refrigeration system of claim 11, further comprising a power supply operable to selective supply an electric current flow to said thermoelectric device.

18. The refrigeration system of claim 11, wherein said heat-transferring fluid is a single-phase fluid in said heat-transfer circuit.

19. A refrigeration system comprising:

a thermoelectric device including a temperature gradient between first and second sides;

a first air flow flowing through a first space in heat-transferring relation with said first side;

a compressible working fluid flowing through a refrigeration circuit in heat-transferring relation with said second side;

wherein heat is extracted from one of said first air flow and said working fluid and transferred to the other of said first air flow and said working fluid through said thermoelectric device.

20. The refrigeration system of claim 19, further comprising a compressor in said refrigeration circuit and wherein said working fluid is compressed by said compressor.

21. The refrigeration system of claim 20, further comprising an evaporator in said refrigeration circuit in heat-transferring relation with a second air flow flowing through a second space, said evaporator extracting heat from said second air flow thereby cooling said second space.

22. The refrigeration system of claim 21, wherein said second side of said thermoelectric device is in heat-transferring relation with said working fluid flowing through said evaporator.

23. The refrigeration system of claim 19, wherein heat is extracted from said first air flow and transferred to said working fluid through said thermoelectric device.

24. A method comprising:

transferring heat between a fluid flowing through a heat-transfer circuit and a first side of a thermoelectric device;

transferring heat between a refrigerant flowing through a vapor compression circuit and a second side of said thermoelectric device.

25. The method of claim 24, further comprising:

removing heat from a first refrigerated space with the heat-transfer circuit;

transferring said removed heat to a cold side of said thermoelectric device;

transferring said removed heat to said ref rifrigerant through a hot side of said thermoelectric device.

26. The method of claim 25, further comprising transferring said removed heat from said refrigerant to the ambient environment with a condenser.

27. The method of claim 25, further comprising:

removing heat from a second refrigerated space with said refrigerant;

transferring said heat removed from said first and second refrigerated spaces from said refrigerant to the ambient environment with a condenser in the vapor compression circuit.

28. The method of claim 27, further comprising:

transferring said heat removed from said first refrigerated space to a first portion of said refrigerant in heat transferring relation with said hot side of said thermoelectric device;

transferring heat from an air flow through said second refrigerated space to a second portion of said refrigerant in heat transferring relation with an evaporator;

joining said first and second portions of said refrigerant together prior to said refrigerant flowing through a compressor.

29. The method of claim 28, further comprising operating said hot side of said thermoelectric device and said evaporator at approximately a same temperature.

30. The method of claim 28, further comprising operating said hot side of said thermoelectric device and said evaporator at different temperatures.

31. The method of claim 25, wherein removing heat from said first refrigerated space includes:

transferring heat from said first refrigerated space to said heat-transfer fluid within said heat exchanger; and transferring heat from said heat-transfer fluid to said cold side of said thermoelectric device.

32. The method of claim 24, further comprising:

supplying an electric current flow to the thermoelectric device thereby creating a temperature gradient between said first and second sides of said thermoelectric device;

cooling a first refrigerated space by transferring heat from said heat-transfer fluid to said refrigerant flow through said thermoelectric device;

defrosting heat exchanger in said heat-transfer circuit by transferring heat to said heat-transfer fluid through said thermoelectric device.

33. The method of claim 24, further comprising maintaining said heat-transfer fluid in a single-phase throughout the heat-transfer circuit.

34. The method of claim 24, further comprising:

removing heat from a first refrigerated space by circulating an air flow through said first refrigerated space and in heat-transferring relation with a cold side of said thermoelectric device;

transferring said removed heat to said refrigerant through a hot side of said thermoelectric device.

35. A method comprising:

transferring heat between a fluid and a first side of a thermoelectric device;

transferring heat between a refrigerant flowing through a vapor compression circuit and a second side of said thermoelectric device;

removing heat from a first refrigerated space by circulating an air flow through said first refrigerated space and in heat-transferring relation with a cold side of said thermoelectric device;

transferring said removed heat to said refrigerant through a hot side of said thermoelectric device;

removing heat from a second refrigerated space with said refrigerant;

transferring said heat removed from said first and second refrigerated spaces from said refrigerant to the ambient environment with a condenser in the vapor compression circuit.

36. The method of claim 24, further comprising creating a temperature gradient between said first and second sides of said thermoelectric device by supplying an electric current flow to said thermoelectric device.

37. The method of claim 35, further comprising creating a temperature gradient between said first and second sides of said thermoelectric device by supplying an electric current flow to said thermoelectric device.

38. The method of claim 37, wherein said first side has a first temperature, said second side has a second temperature, and said first temperature is lower than said second temperature.

39. The method of claim 35, wherein circulating an air flow through said first refrigerated space and in heat-transferring relation with a cold side of said thermoelectric device includes circulating said air flow in direct contact with at least one heat transfer fin which is in heat-transfer relation with said cold side of said thermoelectric device.

40. The method of claim 35, wherein transferring said removed heat to said refrigerant include transferring said removed heat from said hot side of said thermoelectric device to said refrigerant in an evaporator and removing heat from said second refrigerated space includes transferring said heat from said second refrigerated space to said refrigerant in said evaporator.

* * * * *